US011445291B2

(12) United States Patent
Yuen et al.

(10) Patent No.: US 11,445,291 B2
(45) Date of Patent: Sep. 13, 2022

(54) NOISE-REDUCING EARPHONE WITH ADJUSTABLE VOICE

(71) Applicant: Innovation Sound Technology Co., Ltd., Guangdong (CN)

(72) Inventors: Shun Ming Yuen, Guangdong (CN); Wai Yin Mung, Guangdong (CN); Shui Shing Choi, Guangdong (CN); Ka Ming Wu, Guangdong (CN)

(73) Assignee: Innovation Sound Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/223,031

(22) Filed: Apr. 6, 2021

(65) Prior Publication Data

US 2021/0227314 A1 Jul. 22, 2021

Related U.S. Application Data

(63) Continuation of application No. PCT/CN2019/084092, filed on Apr. 24, 2019.

(30) Foreign Application Priority Data

Mar. 20, 2019 (CN) ..... 201920354165.7

(51) Int. Cl.
*H04R 1/10* (2006.01)
*H04R 1/08* (2006.01)

(52) U.S. Cl.
CPC ..... *H04R 1/1083* (2013.01); *H04R 1/08* (2013.01); *H04R 1/1016* (2013.01); *H04R 1/1025* (2013.01); *H04R 1/1041* (2013.01); *H04R 1/1075* (2013.01); *H04R 2420/07* (2013.01)

(58) Field of Classification Search
CPC ..... H04R 1/1083; H04R 1/08; H04R 1/1016; H04R 1/1025; H04R 1/1041; H04R 1/1075
See application file for complete search history.

(56) References Cited

U.S. PATENT DOCUMENTS 8,483,400 B2 * 7/2013 Schreuder ..... H04R 1/1091 381/74
10,708,699 B2 * 7/2020 Boesen ..... H04R 25/602
2019/0278556 A1 * 9/2019 Usher ..... G10L 15/22

FOREIGN PATENT DOCUMENTS

CN 202841470 U 3/2013
CN 207304859 U 5/2018

OTHER PUBLICATIONS

International Search Report of PCT Patent Application No. PCT/CN2019/084092 dated Dec. 9, 2019.

* cited by examiner

*Primary Examiner* — Simon King

(57) ABSTRACT

The application belongs to the field of earphone technology, and discloses a type of noise-reducing earphones with adjustable voice. An audio processor processes voice signals. After a digital signal processor (DSP) completes noise reduction, the signals return to the audio processor, where two signals are combined, through another signal wire. Then the signals are transmitted to a digital-to-analog converter (DAC) that transmits the signals to an acoustic amplifier, where the signals are transmitted to a speaker to realize the adjustment of voice.

4 Claims, 2 Drawing Sheets

NOISE-REDUCING EARPHONE WITH ADJUSTABLE VOICE

CROSS REFERENCE TO RELATED APPLICATIONS

The present application is a Continuation application of PCT Application No. PCT/CN2019/084092 filed on Apr. 24, 2019, which claims the benefit of Chinese Patent Application No. 201920354165.7 filed on Mar. 20, 2019. All the above are hereby incorporated by reference.

FIELD OF THE INVENTION

The application specifically relates to a noise-reducing earphone with adjustable voice, which belongs to the field of earphone technology.

BACKGROUND OF THE INVENTION

Since in-ear earplugs press against the ear canal, they can effectively block external noise, while open earplugs cannot play such a role. Therefore, to listen to music or other sound sources in a noisy surrounding environment, making a buy of in-ear earphones is a good choice for sound insulation. If the in-ear earphones are provided with active noise-reducing function, it will make the sound insulation effect better.

However, due to excellent sound insulation, it is impossible to hear other people's voices on the road (on the street) when going out, which hinders communications. Therefore, it is not recommended to wear such a product for a long time because it hardly meets the needs of the market.

CONTENT OF THE APPLICATION

The technical problem to be solved by the application is to overcome the existing defects and to provide a type of noise-reducing earphones with adjustable voice. A microphone is used to collect external sound, and to send the signal to a preamplifier for amplification and transmission to an analog signal converter. The analog signal converter converts analog signals to digital signals, and then transmits them to the audio processor, where the information is sent to the DSP through one of the signal wires for noise reduction processing. The audio processor processes voice signals. After the DSP completes the noise reduction, the signals return to the audio processor, where two signals are combined, through another signal wire. Then the signals are transmitted to a DAC that transmits the signals to an acoustic amplifier, where the signals are transmitted to speakers to realize the adjustment of voice. The application can effectively solve the problems in the background of the invention.

In order to solve the above technical problems, the present application provides the following technical solutions:

The application offers a type of noise-reducing earphones with adjustable voice, which comprises:

A rubber shell, inside which a main board is fixed. A circuit board, a speaker and a battery are fixed on one side of the main board in order from top to bottom. A microphone and keys are attached on the other side of the main board in order from top to bottom;

An in-ear rubber shell, one end of which is fixed with the rubber shell, and the other end of which is attached with a rubber earplug for being inserted into the inner ear canal;

The upper part of the circuit board is soldered with a Bluetooth circuit, a MCU, a DSP, a sound effect decoder and an acoustic amplifier. The MCU is connected with the Bluetooth circuit via cables, and also with the DSP for noise reduction. The DSP is respectively connected with the sound effect encoder through two signal wires. The sound effect encoder is connected to the speaker through the acoustic amplifier, and also to the microphone for collecting external sound through cables. The microphone transmits the signals to the sound effect encoder, which is connected to the MCU through cables. The MCU and the key used as a switch are connected with cables.

The sound effect encoder consists of the acoustic amplifier, the DAC that converts digital signals to analog signals, the audio processor, and the analog signal converter that converts analog signals to digital signals, and the preamplifier. The preamplifier amplifies the weak signals received by the microphone, and transmits them through cables to the analog signal converter, which is connected via cables to the audio processor, where the signals are processed under the control of the MCU through Bluetooth. The audio processor is connected to the DAC, which is connected to the acoustic amplifies via cables.

As a preferred technical solution of the application, the microphone is connected to the preamplifier via cables.

As a preferred technical solution of the application, the acoustic amplifier is connected to the speaker via cables.

As a preferred technical solution of the application, the DSP is connected to the audio processor through two signal wires respectively.

Beneficial effects achieved by the application: A microphone is used to collect external sound, and to send the signals to a preamplifier for amplification and transmission to an analog signal converter. The analog signal converter converts analog signals to digital signals, and then transmits then to the audio processor, where the information is sent to the DSP through one of the signal wires for noise reduction processing. The audio processor processes voice signal. After the DSP completes the noise reduction, the signals return to the audio processor, where two signals are combined, through another signal wire. Then the signals are transmitted to the DAC that transmits the signals to the acoustic amplifier, where the signals are transmitted to speakers to realize the adjustment of voice.

BRIEF INTRODUCTION OF THE DRAWINGS

The accompanying drawings are used to provide a further understanding of the application and constitute a part of the Specification. Together with the embodiments of the application, they are intended to interpret the application but do not constitute a limitation to the application.

Figure 1:
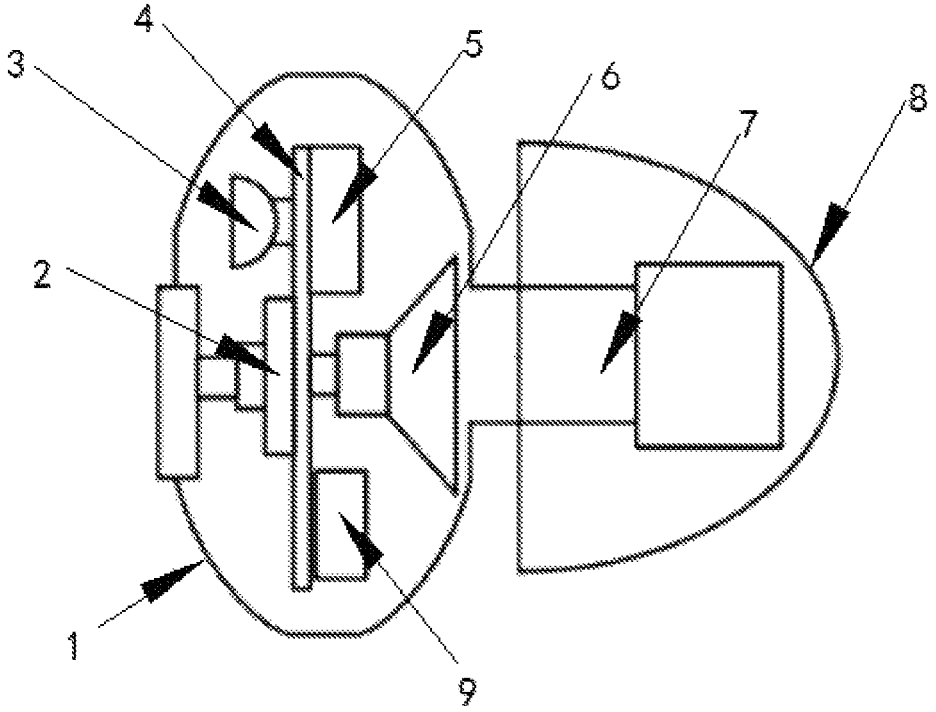
FIG. 1 is a schematic diagram for the overall structure of a noise-reducing earphone with adjustable voice according to embodiments of the application.

Numbers in the drawings: 1. Rubber shell; 2. Keys; 3. Microphone; 4. Motherboard; 5. Circuit board; 6. Speaker; 7. In-ear rubber shell; 8. Rubber earplugs; 9. Battery; 10. Bluetooth circuit; 11. MCU; 12. DSP; 13. Sound effect encoder; 14. Acoustic amplifier; 15. DAC; 16. Audio processor; 17. Analog signal converter; 18. Preamplifier.

DETAILED DESCRIPTION OF THE PREFERRED EMBODIMENTS

The preferred embodiments of the application are described below in conjunction with the drawings. It shall be understood that the preferred embodiments described herein are only used to illustrate and interpret the present application, rather than to limit the present application.

Figure 2:
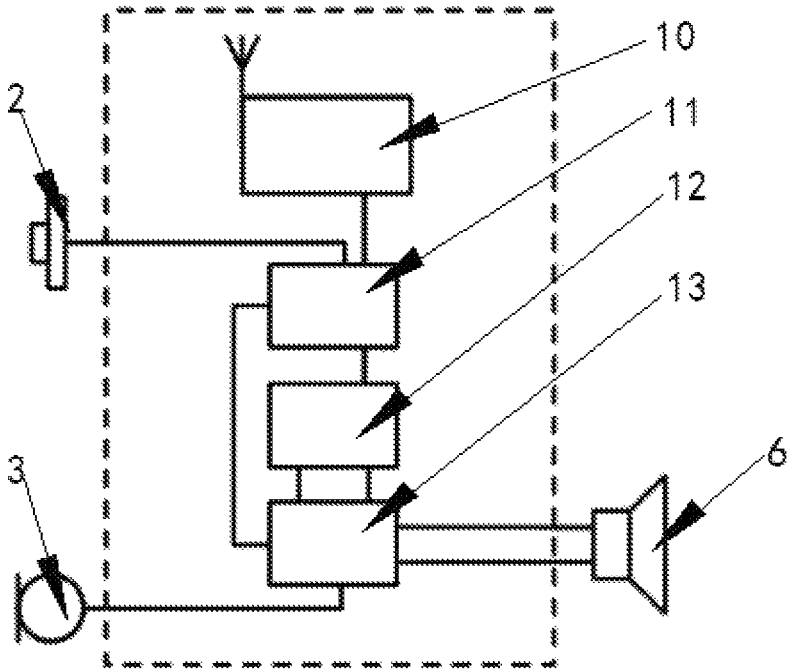
FIG. 2 is a schematic diagram of the circuit board on the upper part of the noise-reducing earphone with adjustable voice according to embodiments of the application.
Figure 3:
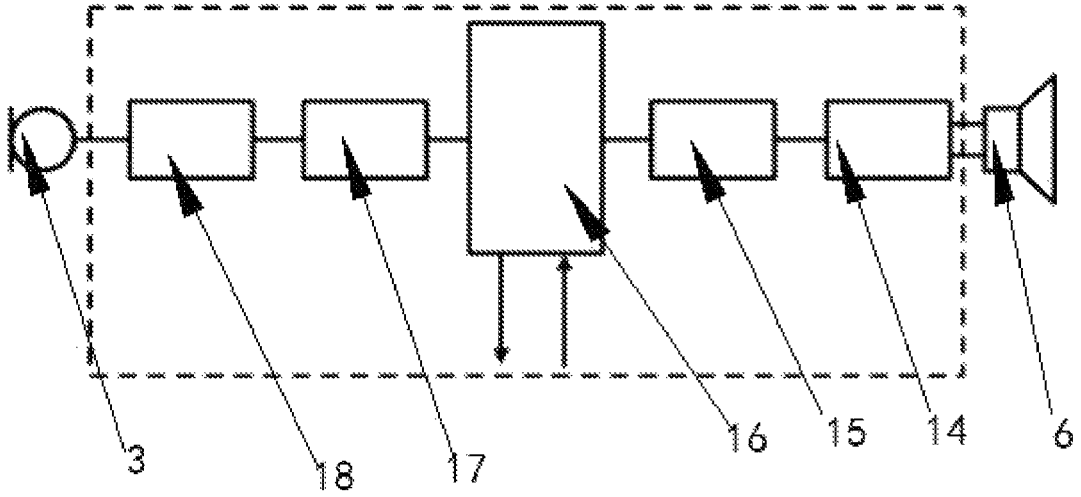
FIG. 3 is a schematic diagram of the sound effect encoder circuit on the upper part of a noise-reducing earphone with adjustable voice according to embodiments of the application.

Embodiments: Please refer to FIG. 1-3. The application offers a type of noise-reducing earphones with adjustable voice, consisting of:

A rubber shell (1), inside which a main board (4) is fixed. A circuit board (5), a speaker (6) and a battery (9) that provides power and ensures the normal operation of the whole circuit, are fixed on one side of the main board (4) in order from top to bottom. A microphone (3) and keys (2) are attached on the other side of the main board (4) in order from top to bottom;

An in-ear rubber shell (7), one end of which is fixed with the rubber shell (1), and the other end of which is fixed with a rubber earplug (8) for being inserted into the inner ear canal;

The upper part of the circuit board (5) is soldered with a Bluetooth circuit (10), a MCU (11), a DSP (12), a sound effect decoder (13) and an acoustic amplifier (14). The MCU (11) is connected with the Bluetooth circuit (10) via cables, and also with the DSP (12) for noise reduction. The DSP (12) is respectively connected with the audio processor (16) inside the sound effect encoder (13) through two signal wires. The sound effect encoder (13) is connected to the speaker (6) through the acoustic amplifier (14), and both of them are connected with each other via cables. The sound effect encoder (13) is connected to the microphone (3) used for collecting external sound through cables.

The microphone (3) transmits the signal to the preamplifier (18), designed to amplifies volume, inside the sound effect encoder (13) that is connected to the MCU (11) through cables. The MCU (11) and the key (2) used as a switch are connected by cables.

The sound effect encoder 13 consists of the acoustic amplifier 14, the DAC 15 that converts digital signals to analog signals, the audio processor 16, and the analog signal converter 17 that converts analog signals to digital signals, and the preamplifier 18. The preamplifier 18 amplifies the weak signals received by the microphone, and transmits them through cables to the analog signal converter 17, which is connected via cables to the audio processor 16, where the signals are processed under the control of the MCU 11 through Bluetooth. The audio processor 16 is connected to the DAC 15, which is connected to the acoustic amplifies 14 via cables.

Working principle: A microphone is used to collect external sound, and to send the signal to a preamplifier for amplification and transmission to an analog signal converter. The analog signal converter converts analog signals to digital signals, and then transmits them to an audio processor, where the information is sent to a DSP through one of the signal wires for noise reduction processing. The audio processor processes voice signals. After the DSP completes the noise reduction, the signals return to the audio processor, where two signals are combined, through another signal wire. Then the signals are transmitted to a DAC that transmits the signal to an acoustic amplifier, where the signals are transmitted to speakers to realize the adjustment of voice.

Last thing to note: The above descriptions are only preferred embodiments of the present invention, and are not used to limit the application. Although the present application has been described in detail with reference to the foregoing embodiments, those skilled in the art may still modify the technical solutions described in the foregoing embodiments, or equivalently replace some of the technical features. Any modification, equivalent replacement, improvement, etc. made within the spirit and principle of the present application shall be included in the protection scope of the present application.

What is claimed is:

1. A type of noise-reducing earphones with adjustable voice, wherein it comprises:

a rubber shell (1), inside which a main board (4) is fixed; a circuit board (5), a speaker (6) and a battery (9) attached on one side of the main board (4) in order from top to bottom; a microphone (3) and keys (2) fixed on the other side of the main board (4) in order from top to bottom;

an in-ear rubber shell (7), one end of which is fixed with the rubber shell (1), and the other end of which is fixed with a rubber earplug (8) for being inserted into inner ear canal;

the upper part of the circuit board (5) being soldered with a Bluetooth circuit (10), an micro-control unit (MCU) (11), a digital signal processor (12), a sound effect encoder (13) and an acoustic amplifier (14); the MCU (11) connected with the Bluetooth circuit (10) via cables, and also with the digital signal processor (12) for noise reduction; the digital signal processor (12) respectively connected with the sound effect encoder (13) through two signal wires; the sound effect encoder (13) connected to the speaker (6) through the acoustic amplifier (14), and also to the microphone (3) used for collecting external sound through cables; the microphone (3) transmitting signals to the sound effect encoder (13), which is connected to the MCU (11) through cables; the MCU (11) and the key (2) used as a switch being connected by cables;

the sound effect encoder (13) consisting of the acoustic amplifier (14), a DAC (15) that converts digital signals to analog signals, an audio processor (16), and an analog signal converter (17) that converts analog signals to digital signals, and a preamplifier (18) that amplifies signals received by the microphone, and transmits them through cables to the analog signal converter (17), which is connected via cables to the audio processor (16), where the digital signals are processed under the control of the MCU (11) through Bluetooth; the audio processor (16) being connected to the DAC (15), which is connected to the acoustic amplifier (14) via cables.

2. The noise-reducing earphone with adjustable voice according to claim 1, wherein the microphone (3) is connected to the preamplifier (18) via cables.

3. The noise-reducing earphone with adjustable voice according to claim 1, wherein the acoustic amplifier (14) is connected with the speaker (6) through cables.

4. The noise-reducing earphone with adjustable voice according to claim 1, wherein the digital signal processor (12) is respectively connected with the audio processor (16) through two signal wires.

* * * * *